US006582816B2

(12) United States Patent
Rasnick, Jr. et al.

(10) Patent No.: US 6,582,816 B2
(45) Date of Patent: Jun. 24, 2003

(54) TEXTILE EFFECT YARNS AND METHOD FOR PRODUCING SAME

(75) Inventors: Lawrence E. Rasnick, Jr., Bristol, VA (US); Arnold L. Belcher, Jr., Bristol, TN (US)

(73) Assignee: Prisma Fibers, Inc., Bristol, VA (US)

( * ) Notice: Subject to any disclaimer, the term of this patent is extended or adjusted under 35 U.S.C. 154(b) by 0 days.

(21) Appl. No.: 09/927,342

(22) Filed: Aug. 13, 2001

(65) Prior Publication Data

US 2002/0032955 A1 Mar. 21, 2002

Related U.S. Application Data

(62) Division of application No. 09/515,641, filed on Feb. 29, 2000, now Pat. No. 6,332,253.

(51) Int. Cl.[7] ..... D01F 6/00; D02G 1/16; D02G 1/18

(52) U.S. Cl. ..... 428/364; 428/357; 57/245; 57/206; 57/246

(58) Field of Search ..... 428/364, 357; 57/245, 205, 246, 350, 244, 247

(56) References Cited

U.S. PATENT DOCUMENTS 4,070,815 A * 1/1978 Negishi et al. ..... 57/140
4,253,299 A * 3/1981 Borenstein ..... 57/246
4,295,329 A * 10/1981 Windley ..... 57/245
4,343,146 A * 8/1982 Nelson ..... 57/208
4,406,310 A * 9/1983 Reader et al. ..... 139/420 R
4,894,894 A * 1/1990 Coons, III et al. ..... 28/220
4,993,218 A * 2/1991 Schwartz et al. ..... 57/208
5,056,200 A * 10/1991 Schwartz et al. ..... 28/258
5,763,076 A * 6/1998 Coons, III et al. ..... 428/364

* cited by examiner

*Primary Examiner*—N. Edwards
(74) *Attorney, Agent, or Firm*—Miles & Stockbridge P.C.; John C. Kerins

(57) ABSTRACT

A process for combining dyed or melt pigmented textile denier accent yarns in small yarn sizes, into a small building block carpet denier bundle to achieve a face yarn bundle having a wide range of special color effects and appearance, not attainable by manufacture of multi-colored carpets from carpet denier fibers alone. The carpet denier singles yarns are drawn, textured and air-jet entangled. At least one textile denier singles yarns, which is preferably a yarn having some degree of orientation, is then entangled with the carpet denier singles yarn, and the bundle is then wound up. The final yarn bundle may contain one or more fiber types, as well as at least one anti-static filament. The two types of singles yarn, i.e., the carpet denier and textile denier types, optionally have the same or different fiber cross-sections.

7 Claims, 2 Drawing Sheets

TEXTILE EFFECT YARNS AND METHOD FOR PRODUCING SAME

This application is a divisional of application Ser. No. 09/515,641, filed Feb. 29, 2000, now U.S. Pat. No. 6,332, 253.

BACKGROUND OF THE INVENTION

1. Field of the Invention

The present invention relates to a continuous process for making carpet face yarns made from two fiber types, and more particularly, to combining singles yarns of higher denier with singles yarns of textile denier to produce face yarns with special color effects and appearance, including improved processes and new products therefrom.

2. Description of Related Art

As used herein, certain terms have the meanings ascribed to them as follows:

The terms "thread" and "filament" are intended to connote single filament fibers, whereas "singles yarn" or "strand" is an assembly of two or more fibers.

The term "node" is intended to mean relatively compact, tangled sections of a yarn that are separated by relatively bulky or unentangled sections.

The term "entangling" is intended to mean the mixing of components to an extent that the individual components cohere to one another, where "cohere" means to stick or hold together in a visually identifiable and distinguishable mass, an example of which is the above-mentioned "node". Entangling includes directing a flow of fluid, such as air, against a moving plurality of filaments transversely of the direction of movement of the filaments. The resulting dislocation of the filaments leads to a knot-like intertwining and entangling of the filaments or strands. The term "air-jet entangler" is a device which produces an entangled yarn by co-mingling the components of the yarn.

A "texturing process" causes a permanent departure from the original longitudinal shape of the filament, for example, by causing the filament to be crimped, or to have some degree of curved or angular change along its length. One example of a texturing process employs a chamber in which yarn is moved at high speed through a flow of heated gas or vapor, i.e., hot air or steam. Alternatively, heated or unheated yarn may be moved at high speed through a mechanical crimping process. The yarn may then be bulked by collision with a surface which, for practical purposes, may be the wad or plug formed by the yarn itself. As a consequence, individual yarns deposit themselves in a bent configuration on an impact surface, and because of heat-induced effects, the yarns retain, to some extent, this curved or angular configuration. When the texturing is accomplished using a heated yarn, the crimped fiber configuration is made permanent by a cooling process, without permitting portions of the yarn to adhere, or be connected, to each other.

A continuing need exists for fiber and yarn producers to offer carpet, floor, and wall covering designers yarns that will provide a unique appearance or will provide unique performance characteristics once tufted, woven, or knitted into pile fabrics or carpet.

Significant resources have been devoted to the manufacture of yarns which have unique attributes. Such yarns have included combinations of fiber building blocks, i.e., singles yarns, of different polymers, fiber cross-sections, fiber denier, or color. For example, U.S. Pat. No. 3,604,197 describes yarns made from a blend of fibers, of the same polymer type, in which one component is a fiber of one particular denier and color, and the other component is of another particular denier and color, where the lower denier component makes up the majority of the final yarn.

U.S. Pat. No. 3,802,177 describes multicolored yarns made from one fiber type of round cross-section and one color, and another fiber type of non-round cross-section and another color. The round cross-section fiber is the majority component, with the non-round component serving as an "accent" yarn. It is significant to note that the patent emphasizes that the desired effects can only be achieved by this particular yarn combination.

Other prior patents disclose various approaches to producing yarn blends or mixtures that will, when tufted into carpet products, provide specifically desired attributes. Examples may be found in U.S. Pat. Nos. 3,994,122; 4,226, 079; 4,472,481; 4,712,366; 4,882,222; 4,993,130; and 5,413,857.

While the prior art, typified by the above-noted patents, may provide a range of products of use to the carpet stylist or wall covering designer, such products do not address the problems currently being faced by the industry and for which adequate solutions have not been found. In particular, there is a continuing trend within the industry toward producing carpets and other pile fabrics with lower face weights. The move toward lower face weights has generally led to carpets that have high tuft density and smaller yarn bundle sizes. Concurrently, this trend is seen as leading to reduced color complexity, at a time when the exact opposite is being requested by stylists, as it becomes more and more difficult to have high numbers of larger denier singles yarns in the final face yarn. In this respect, it is noted that a recognized pleasing and effective aesthetic is the interplay contrast between chromatic color(s) and the neutrality of surrounding or adjacent color(s). The smaller the yarn bundle, the sharper and more dramatic the contrast.

SUMMARY OF THE INVENTION

The present invention involves the production of a range of textile effect yarns made from a process that combines either dyed or melt pigmented textile denier accent yarns having a lower denier per filament (dpf), into a small building block bundle of yarns of a higher denier per filament, referred to herein as a carpet denier. Use of differently colored singles yarns of each type will preserve, or even improve upon, the current level of coloration complexity which can be provided to the carpet or textile producer and stylist. Meanwhile, the use of a blend of textile denier yarns combined into a building block of yarns of a carpet denier permits the production of the desired lower face weight carpets and textile products, while further providing the necessary physical and mechanical properties for a carpet or textile yarn. As an illustration of this, it will be realized that the number of combinations possible using, for example, only 12 base carpet yarn colors and 12 accent textile yarn colors, is in excess of 100,000 combinations. Thus, the desired small yarn sizes can be provided to the customer in a very wide range of colors and effects, which would not be possible using current carpet denier yarn types alone.

It is to be noted that, for the sake of simplicity and conciseness, the specification will, from this point forward, principally refer to the yarns having the higher denier per filament as "carpet denier" yarns, even though the end use of the finished yarn bundle may not be in a carpet product. Yarns of the present invention can be used in tufted or woven textile products, and even in knitted products. The products can be floor coverings, or other horizontal or vertical surface coverings, even though the discussion herein is principally directed to carpet products.

It has unexpectedly been found that, by combining carpet denier singles yarns with textile denier singles yarns in a particular manner, not only is the above-described color complexity achieved, but the physical performance of a tufted carpet made from such yarns is substantially identical to that of similar carpeting made using only carpet denier face yarns. A further aspect of the use of such yarns in producing carpet products is that the tufted carpet exhibits full retention of appearance, as measured by methods known to those skilled in the art, for example, by ASTM Standard D5252 promulgated by The American Society for Testing and Materials, despite the fact that a substantial proportion (but not a majority) of the face yarn used to construct the tufted carpet is composed of low denier, untextured yarns.

The carpet or textile face yarns of the present invention are manufactured in the following manner. The base, carpet denier, singles yarns are spun, and then, as a second process, are drawn, textured and air-tacked. Preferably, two or more carpet denier singles yarns, which may be the same or a different color, are then air-tacked together to form a base bundle. Textile accent singles yarns may preferably be high-speed spun (e.g., at speeds greater than 2500 m/min) as partially oriented yarns (POY). Alternatively, the yarn may be a highly oriented yarn (HOY), or a yarn having a degree of orientation as a result of being direct drawn onto a winder. The yarn should preferably have some degree of orientation in order that it will have the necessary or desired physical properties. The term "oriented textile denier singles yarn" will be used herein to describe yarns having some degree of orientation, whether partially oriented, highly oriented, or any other degree of orientation. One or more of the textile denier accent singles yarns, which may be the same or a different color, and which may each be the same or different color as any of the carpet denier singles yarns, are introduced into the moving base bundle after the base bundle has been drawn and crimp textured and the entire mass is then air-tacked or entangled into a finished yarn bundle before wind-up.

Any of the carpet denier or textile denier singles yarns prior to being combined in making up a carpet face yarn, may be air-tacked by an air entangling device that applies only minimal entangling, so that the singles yarns are sufficiently coherent throughout the manufacturing process.

Both the carpet denier and textile denier singles yarns making up the final carpet face yarn may be based on any fiber forming polymer type, and the singles yarns need not all be of the same polymer type. The filaments making up the yarns may be melt-spun from reclaimed polymeric materials. The singles yarns may contain other additives in addition to colorants. The final carpet face yarn may contain one or more fiber types, as well as one or more anti-static filaments, sufficient in number to provide the desired electrostatic dissipation. In addition, the two types of singles yarn, i.e., the carpet denier and textile denier types, may have either the same or different fiber cross-sections.

Therefore, it is a principal object of the present invention to provide a process for producing textile effect yarns that are suitable for use in producing a low face weight carpet or textile products, and that provide unique appearance characteristics.

A further principal object of the present invention is to provide a process for making textile effect yarn suitable for use in producing carpet having a low face weight and featuring high tuft density and small yarn sizes, while providing an extensive range of coloring effects.

A further object of the present invention is to provide a yarn for making a tufted carpet that exhibits full retention of appearance, in comparison to carpet made wholly of carpet denier singles yarns, despite use of a high proportion of a face yarn component that is composed of partially oriented, low denier, untextured filaments.

It is a further object of the present invention to provide a process for making a textile effect yarn which can be used to provide a broad range of visual aesthetic effects, using only a limited palette of colors.

Still another object of the present invention is to provide a process for making textile effect yarns that offer unique styling possibilities not available by other processing means.

Another object of the present invention is to provide a process for making textile effect yarns wherein the process involves the use of melt pigmented singles yarns.

Another object of the present invention is to provide a process for making textile effect yarns which include both carpet denier singles yarns and textile denier singles yarns, such that a carpet made from the yarns has a physical performance that is substantially identical to the performance of a carpet made using carpet denier yarns alone.

Other objects and benefits of the present invention will become apparent from the following written description and accompanying figures.

BRIEF DESCRIPTION OF THE DRAWINGS

The above and other features of the present invention and the attendant advantages will be readily apparent to those having ordinary skill in the art and the invention will be more easily understood from the following detailed description of the preferred embodiments of the present invention, taken in conjunction with the accompanying drawings.

DESCRIPTION OF THE PREFERRED EMBODIMENTS

Figure 1:
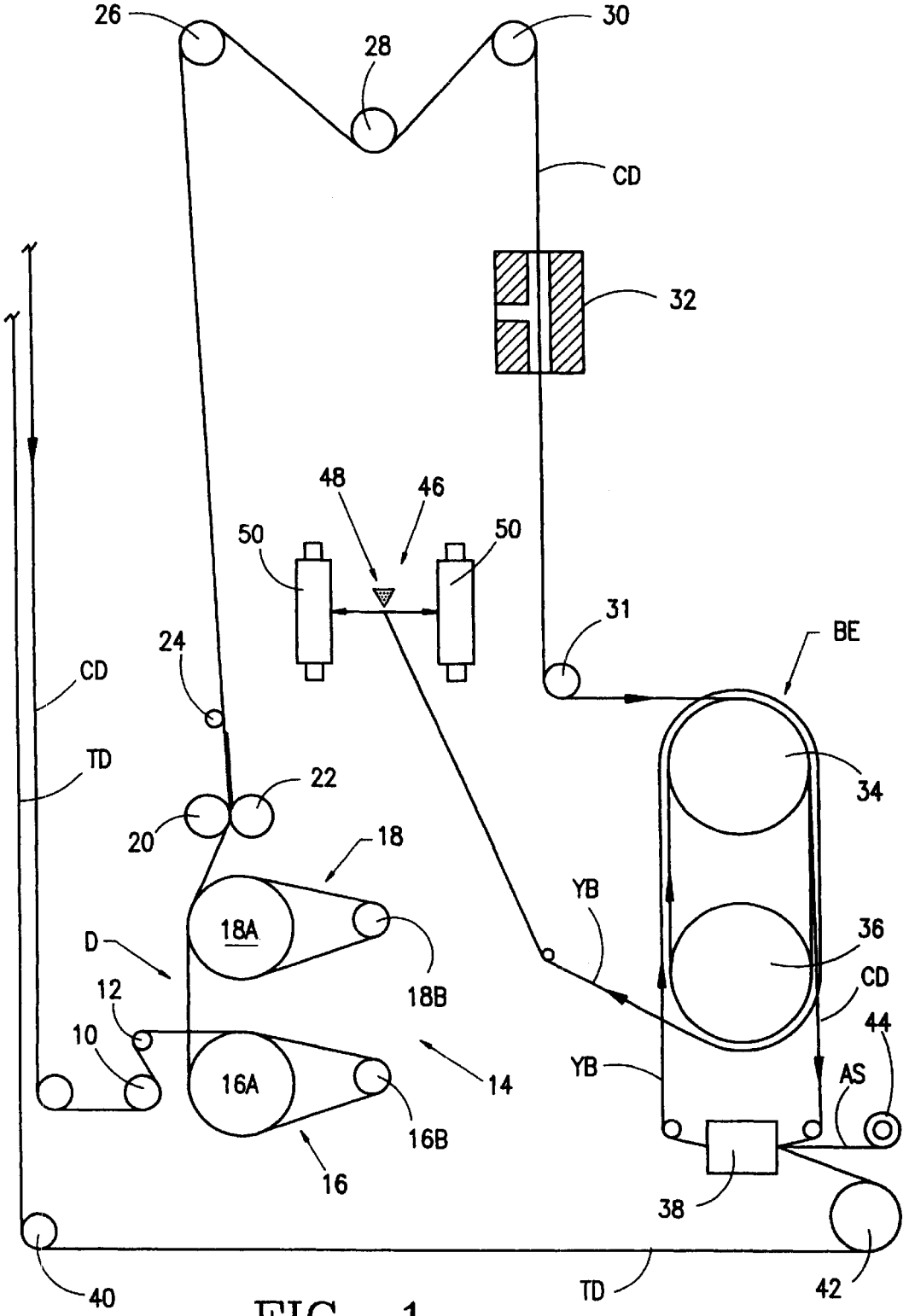
FIG. 1 schematically illustrates an apparatus according to the present invention, and for performing the process of the present invention.

FIG. 1 is a schematic representation of a preferred apparatus of the present invention for producing a carpet yarn which combines carpet denier singles yarns CD with textile denier singles yarns TD to produce a finished yarn bundle that, when tufted into carpet, produces appealing visual aesthetics.

The terms "carpet denier" and "textile denier" have specific meanings within the fiber art, in terms of the limitations of fiber processing, and the required physical properties of the fibers, particularly in determining the suitability of a fiber for use in producing carpeting. In the present invention, it is preferred, as is generally recognized in the art, that the carpet denier singles yarns have a denier per filament (dpf) of greater than about 10 dpf and up to about 30 dpf, and that the textile denier singles yarns have a dpf of between about 2 dpf and about 10 dpf.

These distinctions have come about as a result of the fact that yarns having a large denier per filament have historically provided greater resistance to applied loads without breakage or loss of elastic recovery, coupled with the fact that yarns having a large denier per filament count can be produced relatively easily and at reasonably low cost using melt-extrusion processes. Yarns having a lower denier per filament count are finer and have a softer "hand", or feel, due at least in part to the smaller denier per filament value. Such yarns have been used in producing textiles, where the softer hand is a more desirable attribute, thus justifying the added difficulty and cost associated with their production. These textile denier yarns, however, generally do not have the physical properties required to be used in the production of durable tufted carpet.

In the FIG. 1 apparatus, at least one, and preferably more than one, prespun singles yarns CD of a carpet denier are delivered from a reel (not shown), via a pair of infeed rolls 10, 12, to a draw section 14 of the apparatus. The singles yarns CD travel from the infeed rolls to a first heat roll stage 16, where the singles yarns are heated in a step in preparation for being drawn. The heated singles yarns leaving first heat roll stage 16 are taken up in second heat roll stage 18. The pair of rollers 18A, 18B making up second heat roll stage 18, rotate at speeds slightly in excess of the corresponding rolls 16A, 16B of the first heat roll stage 16. As a result, a draw zone D is produced in the space between the rolls, and the carpet denier singles yarns CD are drawn at a ratio preferably in the range of about 2.5 to about 4.0, and even more preferably in the range of about 2.88 to about 3.6.

The drawn singles yarns CD are taken off the rollers of second heat roll stage 18 and proceed to a texturing section. As shown in FIG. 1, the texturing is preferably accomplished using a pair of co-rotating crimper wheels 20, 22, which produce a mechanical crimp by subjecting the singles yarns to frictional forces between the crimper wheels, as is well known in the art. It is to be noted that, while a mechanical crimping device is shown in the illustrated preferred embodiment, the texturing can be achieved by other known methods, such as by using air-jet texturing devices.

After passing through crimping wheels 20, 22, the singles yarns undergo tension control, for example, by passing over a doctor bar 24, and through a series of tension rolls 26, 28, 30. The tension control is preferably a tension adjustment that relaxes the singles yarns CD.

Figure 2:
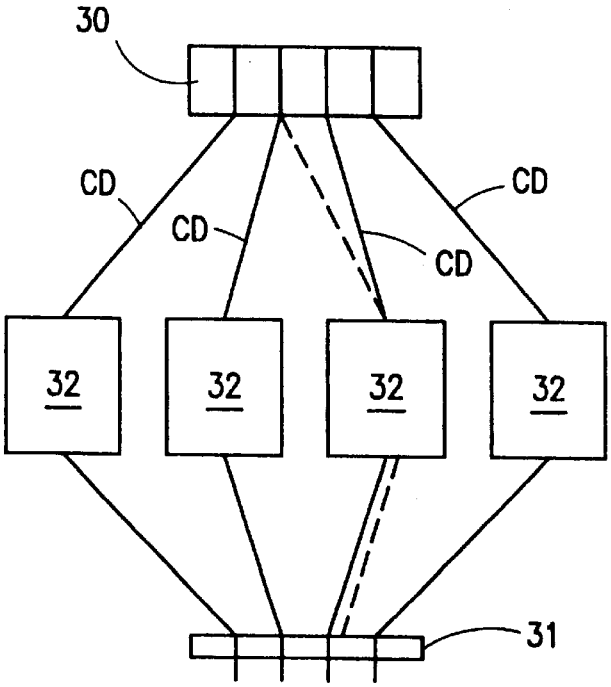
FIG. 2 is a schematic illustration of a set of air-jet entanglers used to individually entangle the carpet denier singles yarns.

The singles yarns CD, upon exiting the tension control section, are preferably segregated or split out, and each is passed through an individual entangling device, shown schematically in FIG. 1 as an air-jet entangler 32, of a type known in the art, which tacks or entangles each singles yarn CD at regular, periodic intervals. FIG. 2 presents a schematic view showing four singles yarns coming off of the last tension roll 30, and being split out to four separate entanglers, and then rejoined at guide pin 31 for further processing.

Figure 3:
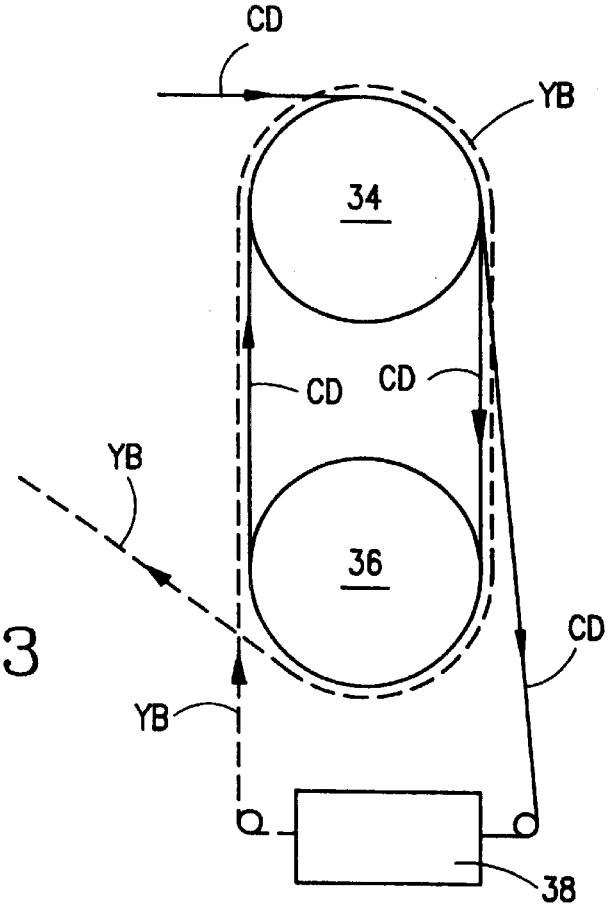
FIG. 3 is a schematic illustration of the paths of travel of the yarns in and through the entanglement control rolls and second, main entangler.

The individually entangled singles yarns CD are next transported to a bundle entangling section BE, which preferably comprises a pair of entanglement control rolls 34, 36, and a main bundle entangler 38. Having reference to FIG. 3 in conjunction with FIG. 1, it can be seen that the group of incoming carpet denier singles yarns CD wrap to the back side of first entanglement control roll 34, and travel down to the back side of second entanglement control roll 36. The singles yarn CD travel up the front sides of the second and first entanglement control rolls, and wrap around the roll pair for a predetermined number of wraps, which may preferably be four wraps.

The entanglement control rolls are preferably stepped to present two or more different diameters or different lengths for the path of yarn travel. In that manner, the feed of these singles yarns CD can be controlled to provide various desired levels of underfeed or overfeed to main bundle entangler 38.

Upon completing the several wraps around the roll pair, singles yarns CD are sent to main bundle entangler 38. Main bundle entangler 38 may also preferably be a known type of air-jet entangler, which is set to produce repetitive, regular tacks in the yarn bundle passing therethrough.

At the entrance to the main bundle entangler, one or more textile denier singles yarns TD are introduced to form, with the carpet denier yarns CD, a yarn bundle YB. The main bundle entangler entangles the textile denier yarns TD and the carpet denier yarns in forming the yarn bundle YB. The textile denier yarns are fed to the main bundle entangler by known, conventional singles yarns handling means, shown schematically in FIG. 1 as first and second guide rolls 40, 42, which transport and guide the textile denier singles yarns from a reel or spool (not shown) to the main bundle entangler. Textile denier singles yarns TD, in addition to being in the range of about 2–10 dpf, are also preferably undrawn, partially oriented yarns (POY).

Also optionally introduced to the main bundle entangler 38 are one or more antistatic filaments AS. The filaments are fed to the bundle entangler by any known method, and are shown in FIG. 1 as being wound off of spool 44. The antistatic filaments are entangled with the carpet denier and textile denier yarns, and form part of the final yarn bundle YB.

After exiting the main bundle entangler, yarn bundle YB preferably travels to the entanglement control rolls 34, 36, first along a front face of the lower and upper rolls, and then wraps around the roll pair for a number of wraps. The yarn bundle is then taken off of the entanglement control rolls, and is directed to a take-up section, shown schematically at 46, where the yarn bundle YB is directed or diverted by diverting means 48 to one of a plurality of spools 50.

The yarn bundle YB thus produced is preferably used as a carpet face yarn for tufting into carpet products. The plurality of carpet denier singles yarns CD used in forming the yarn bundle/carpet face yarn may preferably be all of the same color, but may also be all differently colored, or have some singles yarns differently colored from others. The textile denier singles yarns TD may also be all of the same color, preferably different from a color of the carpet denier yarns, or individual textile denier singles yarns may be differently colored from all or some of the other textile denier singles yarns. In this manner, a wide variety of coloring effects may be achieved.

The process for producing the textile effect carpet yarns of the present invention can thus be summarized in the following steps:

(a) delivering one or more prespun carpet denier singles yarns to a drawing subassembly where the carpet denier singles yarns are heated and drawn to a desired, predetermined draw ratio;

(b) texturing the drawn carpet denier singles yarns;

(c) entangling, either individually, collectively, or partially individually and partially collectively, the drawn and textured carpet denier singles yarns;

(d) forming a yarn bundle by entangling all of said one or more drawn, textured and entangled carpet denier yarns with one or more undrawn, partially oriented, textile denier singles yarns; and (e) winding up said yarn bundle.

As noted in step (c) above, the carpet denier singles yarns may optionally be each individually entangled at the first entangling stage, or may all be collectively entangled, or some of the singles yarns may be collectively entangled, with one or more other singles yarns being individually entangled.

Other optional and/or preferred steps include entangling, in the yarn bundle forming step, one or more antistatic filaments with the carpet denier singles yarns and the textile denier singles yarns. Also, the drawing subassembly and drawing step may preferably include wrapping the singles yarns over a first roll pair which includes a heated roll, and transporting the singles yarns to a second roll pair which includes a heated roll, and controlling the rotational speeds of the roll pairs to create a draw zone between the roll pairs. The drawn and textured singles yarns may further be passed through a tension control zone prior to being entangled. The drawn, textured and entangled yarns may be directed to and wrapped around a pair of entanglement control rolls, and the speed of those rolls controlled to produce an overfeed or underfeed condition at the main entangling box. Further, the entangled yarn bundle may be passed over the entanglement control rolls prior to being wound up.

The finished yarn bundle preferably comprises a majority component of carpet denier singles yarns, with the textile denier singles yarns comprising a minority component. Even more preferably, the carpet denier singles yarns make up from about 65 to about 75% by weight of the finished yarn bundle. When the yarn bundle is principally made up of carpet denier singles yarns, the untextured POY textile denier accent yarns retain their coherence in the final product, and the presence of bright color accents along the yarn bundle gives the appearance of a surprisingly wide range of coloration when tufted into carpeting.

The carpet denier singles yarns for use in the final textile effect carpet yarn bundles may be based on any spinnable fiber forming polymer, and are preferably melt-spinnable polymers such as polyamides, polyesters, or polyolefins. Representative polymers which would be particularly well suited for use in this invention include Nylon 6, Nylon 66, PET, PBT, PTT, PP, and copolymers and blends thereof. The textile denier singles yarns used in forming the textile effect carpet yarn bundles of the present invention are preferably continuous filament yarns, preferably partially oriented yarns (POY). Textile denier POY yarns are generally spun at speeds greater than 2500 m/min.

Advantageously, the process of the present invention preferably uses melt pigmented, also known as solution-dyed, singles yarns, which have been found to offer superior end-use performance, e.g., low color fade and resistance to harsh cleaning methods. Any or all of the singles yarns making up the yarn bundle may contain, in addition to colorants, other additives. These include, but are not limited to, delustrants, anitmicrobials, stainblockers, antioxidants, UV stabilizers, and process aids. In addition, the two types of singles yarn, i.e., the carpet denier and textile denier types, optionally have the same or different fiber cross-sections. Such cross-sections include any profile, including, but not limited to, round, multilobal, dumbbell, irregular, hollow and grooved profiles. Optionally, the final yarn may contain one or more fiber types, as well as at least one anti-static filament.

In a further embodiment of the invention, in which the manufacture of carpet denier singles yarns and textile denier singles yarns is based on polymers different from one another, it is preferred that the relative heat shrinkage properties of the polymers are such that little or no differential shrinkage of the two singles yarn types occurs during or after manufacture.

The textile effect carpet yarn according to the present invention includes at least one textured, entangled, carpet denier singles yarn having a first denier per filament and at least one partially oriented textile denier singles yarn having a second denier per filament, wherein both types of singles yarns either are of a single color, or in the case of respective multiple singles yarns, are either differently colored, colorable the same, or colorable differently. Moreover, the at least one carpet denier singles yarn and the at least one partially oriented textile denier singles yarn are, alternatively, one of the same color, differently colored, colorable the same, or colorable differently, with respect to each other.

It has been determined, in connection with the development of the present invention, that a very broad range of combinations leading to numerous different visual effects can be achieved using, for example, a base set of twelve (12) basic carpet denier yarn colors and twelve (12) accent textile denier yarn colors. The use of this relatively small base set of yarns will nonetheless permit the fiber producer to supply in excess of 100,000 different combinations, having varying ranges of colors and effects in a tufted carpet, to the carpet manufacturers. This scale is not achievable using current carpet denier fibers alone.

As has been noted previously, it has further been found that, not only is the desired range of color complexity achieved, the physical performance of carpet products made from the yarns, which include textile denier yarns combined with carpet denier yarns, with the carpet denier yarns making up the majority of the yarn bundle, is substantially identical to the physical performance of carpets made of yarns produced solely with carpet denier fibers.

In still another embodiment, any, or all, of the singles yarns making up the final carpet face yarn are based on melt-spun fibers made from reclaimed polymeric materials. In particular, the reclaimed polymeric materials to be used are polymeric fibrous waste.

EXAMPLE

Three as-spun, solution-dyed, sulphonated Nylon 66 singles yarns of 1850/30Y (1850 denier, 30 filaments, 61.7 dpf, Y-cross section) configurations (two colored charcoal and one colored mid-gray), were separately drawn to 600/30Y (30 filaments, 20 dpf), and combined together through the steps of stuffer box texturing and air-jet entangling. Four textile denier solution-dyed Nylon 6 POY yarns of 200/20R, approximately 10 dpf, configuration (bright red, bright yellow, pale green and white) were then introduced together into the above yarn bundle, and the whole passed through an air-jet entangling step, and repetitively or regularly tacked, to produce a finished yarn bundle suitable for use as a carpet face yarn. Carpet samples made by tufting this yarn bundle product onto a standard backing exhibited a dark gray background, with numerous highlights (single color and multiple color) as a result of the inclusion of the red, white, green and yellow effect yarns.

A series of "simulated floor" tests were performed on the carpet samples at Professional Testing Laboratory, Dalton, Ga., and the samples were returned and evaluated in-house, for wear. In addition, tests using a HexapodNetterman drum (ASTM Standard D5252), a Tetrapod, and Chair Casters, were also conducted, and the carpet samples were evaluated for wear by in-house personnel. The following scale or key was used to rate the wear evidenced on the carpet:

Score Description

5 Excellent, No Change or negligible change

4 Good, Slight change due to pile disturbance

3 Fair-Noticeable wear pattern due to pile crushing or matting

2 Poor-Loss of texture and thickness due to pile crushing or matting

1 Very Poor—Severe pile crushing and/or matting, generally considered unacceptable The results of the tests are presented in Table I below.

TABLE I

| Carpet Sample | Test | Cycles | Score |
|---|---|---|---|
| 1 (Dark Blue) | SimFloor | 12K | 3.5 |
| | | 24K | 3 |
| 2 (Black) | SimFloor | 12K | 4 |
| | | 24K | 3.5 |
| 3 (Blk/Beige) | SimFloor | 12K | 4 |
| | | 24K | 3.5 |
| 4 (Grey) | SimFloor | 12K | 3.5 |
| | | 24K | 3 |
| 5 (Brown) | SimFloor | 12K | 3.5 |
| | | 24K | 3.5 |
| 6 (Lt. Grey) | SimFloor | 12K | 3.5 |
| | | 24K | 3 |
| 7 (Blk/Beige) | SimFloor | 12K | 4 |
| (Standard BCF) | | 24K | 3.5 |
| 8 (Blk/Beige) | SimFloor | 12K | 4 |
| (invention-carpet | | 24K | 4 |
| denier + textile denier) | | | |
| 9 (Beige/Blk) | Vetterman Drum | 22K | 3 |
| 10 (Beige/Blk) | Tetrapod | 100K | 4.5 |
| 11 (Beige/Blk) | Chair Caster | 5K | 4.5 |
| 12 (Beige/Blk) | Chair Caster | 10K | 3.5 |
| 13 (Beige/Blk) | Chair Caster | 20K | 3 |
| 14 (Beige/Blk) | Chair Caster | 50K | 2.5 |

It can be seen from the above results that carpet made from the bundles comprising a mix of carpet denier fibers (the predominant portion) and textile denier fibers perform very well in resistance to wear. Indeed, in the head-to-head comparison shown in Samples 7 and 8, where like-colored standard BCF carpet (yarns having carpet denier fibers only) and carpet made from the yarn of the present invention were tested under substantially identical conditions, the carpet of the present invention actually slightly outperformed the standard BCF yarn, in terms of wear resistance. The yarn bundles produced in accordance with the present invention thus provide the significant advantage of allowing a wide variety of styling options, while sacrificing little or nothing in terms of wear resistance.

While this invention has been described in conjunction with specific embodiments thereof, it is evident that many alternative modifications and variations will be apparent to those skilled in the art. Accordingly, the preferred embodiments of the invention as set forth herein are intended to be illustrative, not limiting. Various changes may be made without departing from the true spirit and scope of the invention as defined in the following claims.

What is claimed is:

1. A textile effect yarn bundle comprising:

at least one textured, entangled, carpet denier singles yarn having a first denier per filament; and at least one oriented, untextured textile denier singles yarn having a second denier per filament which is lower than said first denier per filament, wherein said at least one oriented, untextured textile denier singles yarn is air-tacked with said at least one textured, entangled, carpet denier singles yarn, and wherein said at least one oriented, untextured textile denier singles yarn is of a different color than said at least one carpet denier singles yarn, and wherein said yarn bundle is composed principally of carpet denier singles yarn.

2. The textile effect yarn of claim 1 further including at least one filament of an antistatic polymeric fiber.

3. The textile effect yarn of claim 1, wherein at least one of said at least one textured, entangled, carpet denier singles yarn and said at least one oriented textile denier singles yarn is manufactured from reclaimed polymeric materials.

4. The textile effect yarn of claim 1, further comprising at least two textured entangled carpet denier singles yarns.

5. The textile effect yarn of claim 4, further comprising at least two oriented textile denier singles yarns.

6. The textile effect yarn of claim 1, wherein said at least one oriented textile denier singles yarn is a partially oriented yarn (POY).

7. The textile effect yarn of claim 1, wherein said at least one oriented, untextured denier singles yarn is a drawn yarn.

* * * * *